US007575637B2

(12) United States Patent
Das et al.

(10) Patent No.: US 7,575,637 B2
(45) Date of Patent: Aug. 18, 2009

(54) METHODS AND APPARATUS FOR TURBINE ENGINE COMPONENT COATING

(75) Inventors: Nripendra Nath Das, West Chester, OH (US); W. Michael Gmerek, Jr., West Chester, OH (US); David W. Koch, Pleasant Plain, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/447,806

(22) Filed: Jun. 6, 2006

(65) Prior Publication Data

US 2006/0216422 A1 Sep. 28, 2006

Related U.S. Application Data

(62) Division of application No. 10/458,991, filed on Jun. 11, 2003, now Pat. No. 7,122,224.

(51) Int. Cl.
*B05C 21/00* (2006.01)

(52) U.S. Cl. ..... 118/504; 118/505

(58) Field of Classification Search ..... 118/504, 118/505; 427/282; 29/889, 889.2
See application file for complete search history.

(56) References Cited

U.S. PATENT DOCUMENTS 2,324,184 A * 7/1943 Wyman ..... 118/500
3,474,250 A * 10/1969 Jelatis et al. ..... 250/515.1
3,548,494 A * 12/1970 Haring ..... 29/847
3,577,325 A * 5/1971 Fairchild ..... 205/150
6,042,898 A 3/2000 Burns et al.
6,168,874 B1 1/2001 Gupta et al.
6,322,671 B1 11/2001 Mingazhev
6,326,057 B1 12/2001 Das et al.
6,363,612 B1 * 4/2002 Roberts et al. ..... 29/889.1
6,503,574 B1 1/2003 Skelly et al.
6,579,567 B1 6/2003 Das et al.
6,592,948 B1 7/2003 Fusaro, Jr. et al.
6,706,323 B2 3/2004 Wheat et al.
6,821,564 B2 11/2004 Das et al.
6,989,174 B2 1/2006 Heng et al.

* cited by examiner

*Primary Examiner*—Laura Edwards
(74) *Attorney, Agent, or Firm*—William Scott Andes, Esq.; Armstrong Teasdale LLP

(57) ABSTRACT

A method for processing a substrate article is provided. The method includes masking a first portion of the substrate article with a maskant that includes a formed graphite piece that overlays and contacts the first portion of the substrate such that a second portion of the substrate is not overlaid nor contacted by the maskant; and processing the substrate article such that a coating of material is deposited on the second portion of the substrate, and wherein the maskant facilitates preventing the coating from being deposited on the first portion of the substrate article.

9 Claims, 3 Drawing Sheets

METHODS AND APPARATUS FOR TURBINE ENGINE COMPONENT COATING

CROSS-REFERENCE TO RELATED APPLICATIONS

This application is a divisional of Ser. No. 10/458,991 filed on Jun. 11, 2003 U.S. Pat. No. 7,122,224, issued Oct. 17, 2006 which is hereby incorporated by reference and is assigned to the assignee of the present invention.

BACKGROUND OF THE INVENTION

The invention relates generally to components of the hot section of gas turbine engines, and more particularly, to a process for depositing a coating onto a selective area of a turbine component.

In gas turbine engines, for example, aircraft engines, air is drawn into the front of the engine, compressed by a shaft-mounted rotary compressor, and mixed with fuel. The mixture is burned, and the hot exhaust gases are passed through a turbine coupled to a shaft. The flow of gas turns the turbine, which drives the compressor. The hot exhaust gases flow from the back of the engine, providing thrust that propels the aircraft forward.

During operation of gas turbine engines, at least some components within the engine, maybe in contact with high temperature gases. Such components may include, for example, blades, vanes, and nozzles used to direct the flow of the hot gases.

To facilitate shielding the metallic parts from the combustion gases, environmental coatings may be applied to the components. Such environmental coatings may be produced by holding the part to be coated at a temperature in an atmosphere that is rich in a certain element or elements, often aluminum. The elements diffuse onto the surface of the part and form a diffusion coating in a process known as diffusion aluminide. In one form, the environmental coating is fabricated from a diffusion cobalt aluminide, nickel aluminide or platinum aluminide. The diffusion aluminide coating surface forms an aluminum oxide scale when exposed to oxygen-containing atmospheres at elevated temperatures, thus facilitating increased resistance to additional high temperature oxidation.

At least some other known component coating processes demand labor-intensive processes. For example, when the component is a low pressure turbine (LPT) nozzle, known coating processes require a labor intensive masking process wherein a commercially available aluminum gettering masking tape is applied to the desired area of the turbine component. More specifically, the tape is affixed in place using a sheet metal strip. However, continued exposure to the high temperatures utilized by the coating process, may cause the sheet metal strip to warp, such that the strip fails to provide adequate support for the masking tape. As a result the masking tape may undesirably dislodge from the component during the aluminide coating process, and an undesired area of the turbine nozzle may be aluminided.

BRIEF DESCRIPTION OF THE INVENTION

In one aspect, a method for processing a substrate article is provided. The method includes masking a first portion of the substrate article with a maskant that includes a formed graphite piece that overlays and contacts the first portion of the substrate such that a second portion of the substrate is not overlaid nor contacted by the maskant; and processing the substrate article such that a coating of material is deposited on the second portion of the substrate, and wherein the maskant facilitates preventing the coating from being deposited on the first portion of the substrate article.

In another aspect, a method for coating a gas turbine engine turbine engine nozzle with an environmental coating is provided. The method includes masking a first portion of the turbine engine nozzle with a maskant including a formed graphite piece that overlies and contacts the first portion of the nozzle, such that a second portion of the nozzle remains exposed, and depositing a coating on the second portion of the nozzle without removing the maskant such that the maskant facilitates preventing the coating from being deposited on the first portion of the nozzle.

In yet another aspect, a coating mask for use in coating a substrate is provided. The mask includes a first interlocking segment end, an opposite second interlocking segment end and a body extending therebetween, each interlocking segment end is configured to interlock with a respective interlocking end of an adjacent segment such that a plurality of interlocking segments overlay a substrate article first portion. The body includes a formed graphite mask segment configured to isolate a portion of the substrate article from a coating atmosphere, and a contour surface shaped to conform to a first portion of the substrate article.

DETAILED DESCRIPTION OF THE INVENTION

Nickel-base superalloy components of gas turbines are sometimes coated with aluminum and then heated to diffuse the aluminum into the surface of the article. The aluminum-rich surface is oxidized to produce an adherent aluminum oxide scale on the surface of the article. The aluminum oxide scale is an effective barrier against further oxidation and corrosion of the component in service.

The aluminum coating is typically applied by a vapor phase deposition process. In one embodiment, aluminum containing a cobalt-aluminum donor alloy and a halide activator, such as aluminum fluoride gas, is contacted to the component surface under conditions such that the compound decomposes to leave a layer of aluminum deposited on the surface. The aluminum diffuses into the surface during the deposition and any post-deposition heat treatment, producing the aluminum-enriched surface region.

It is sometimes the case in such deposition processes that a first portion of the surface of the article is to be left uncoated, and a second portion of the surface of the article is to be coated with aluminum. In order to prevent deposition of aluminum from the aluminum-containing gas, the first (uncoated) portion of the surface of the article is physically covered with a mask. The mask prevents contact of the aluminum-containing gas to the first portion. These maskants are intended to prevent the coating vapors from reaching the surface of the article, and to prevent depletion of the alloy components from the surface of the first portion of the surface.

Figure 1:
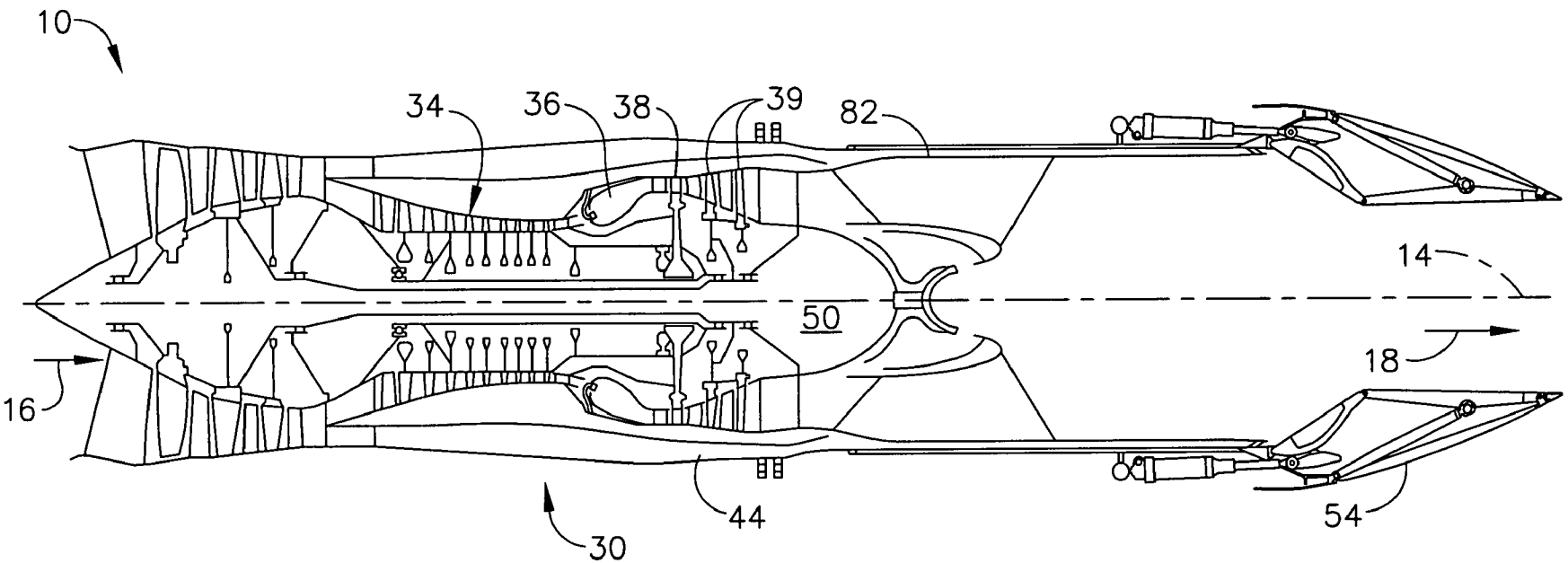
FIG. 1 is a cross-sectional side view of an exemplary gas turbine engine.

FIG. 1 is a cross-sectional side view of an exemplary gas turbine engine 10. In one embodiment, engine 10 is an F110/

129 engine available from General Electric Aircraft Engines, Cincinnati, Ohio. Engine 10 has a generally longitudinally extending axis or centerline 14 extending in a forward direction 16 and an aft direction 18. Engine 10 includes a core engine 30 which includes a high pressure compressor 34, a combustor 36, a high pressure turbine 38, and a power turbine or a low pressure turbine 39 all arranged in a serial, axial flow relationship. In an alternative embodiment, core engine 30 includes a compressor, a detonation chamber, and a turbine arranged in a serial, axial flow relationship. Engine 10 also includes a bypass duct 44 that surrounds core engine 30, and enables fluid flow to be routed downstream from core engine 30 rather than through core engine 30. In an alternative embodiment, engine 10 includes a core fan assembly (not shown). An annular centerbody 50 extends downstream from core engine 30 toward a variable geometry exhaust nozzle 54.

During operation, airflow enters engine 10 and fuel is introduced to core engine 30. The air and fuel are mixed and ignited within core engine 30 to generate hot combustion gases. Specifically, pressurized air from high pressure compressor 34 is mixed with fuel in combustor 36 and ignited, thereby generating combustion gases. Such combustion gases drive high pressure turbine 38 which drives high pressure compressor 34. The combustion gases are discharged from high pressure turbine 38 into low pressure turbine 39. The core airflow is discharged from low pressure turbine 39 and directed aftward towards exhaust nozzle 54.

Figure 2:
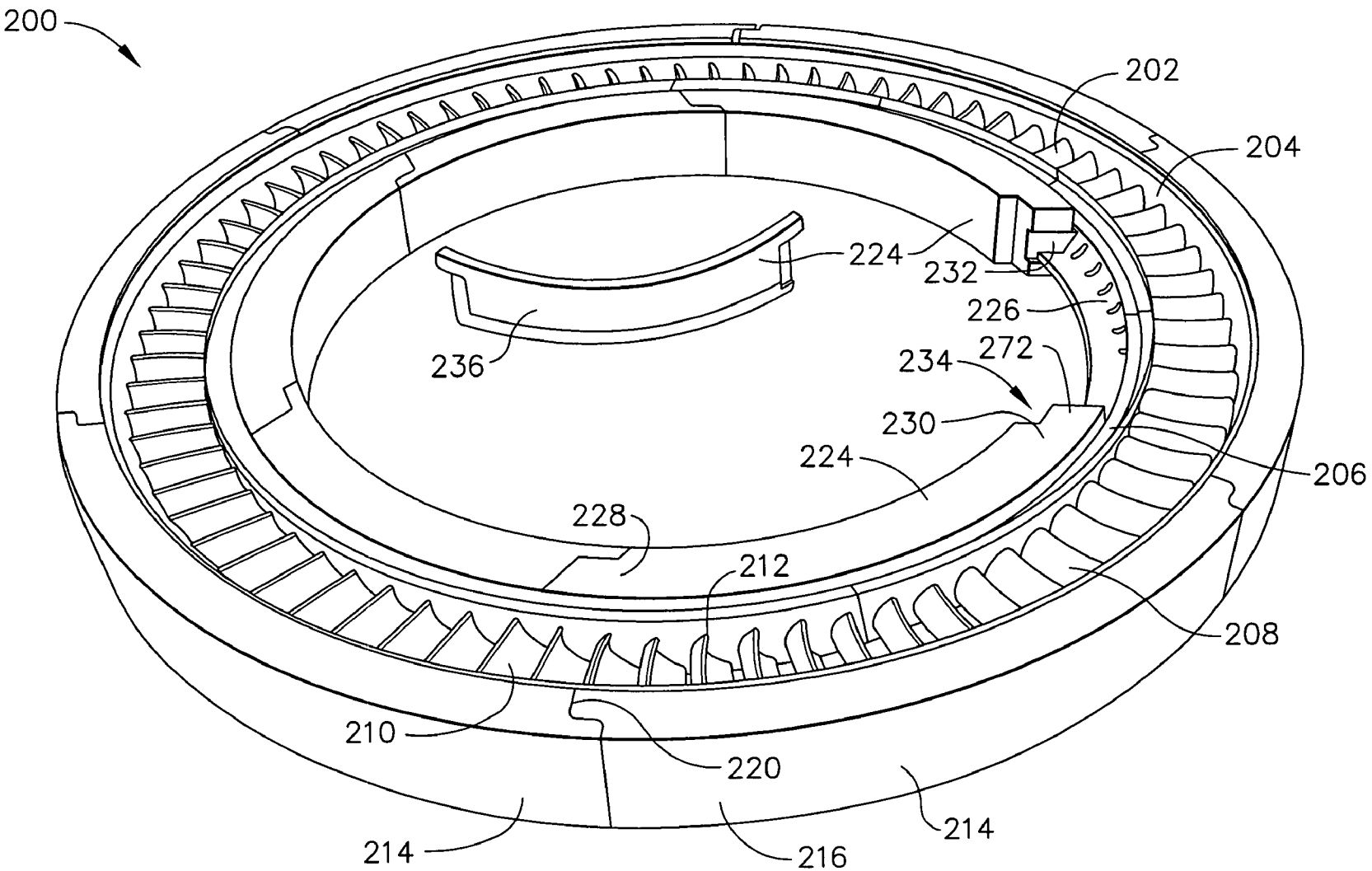
FIG. 2 is a perspective view of an exemplary low pressure turbine nozzle that may be used with a gas turbine engine, such as the gas turbine engine shown in FIG. 1.

FIG. 2 is a perspective view of an exemplary low pressure turbine nozzle 200 that may be used with a gas turbine engine, such as gas turbine engine 10 (shown in FIG. 1). Nozzle 200 includes a plurality of circumferentially-spaced airfoil vanes 202 coupled together by an arcuate radially outer band or platform 204, and an arcuate radially inner band or platform 206. More specifically, in the exemplary embodiment, each band 204 and 206 is integrally-formed with airfoil vanes 202.

In the exemplary embodiment, each airfoil vane 202 includes a first sidewall 208 and a second sidewall 210. First sidewall 208 is convex and defines a suction side of each airfoil vane 202, and second sidewall 210 is concave and defines a pressure side of each airfoil vane 202. Second sidewall 210 is joined to first sidewall 208 at a leading edge 212 and at an axially-spaced trailing edge (not shown) of each airfoil vane 202. More specifically, each airfoil trailing edge is spaced chordwise and downstream from each respective airfoil leading edge 212.

Second sidewall 210 and first sidewall 208 extend longitudinally, or radially outwardly, in span from radially inner band 206 to radially outer band 204. Additionally, second sidewall 210 and first sidewall 208 define a cooling cavity (not shown) within each airfoil vane 202. More specifically, the cooling cavity is bounded by an inner surface (not shown) of each airfoil sidewall, and extends through each band 204 and 206.

In the exemplary embodiment, nozzle 200 is fabricated from a nickel-base superalloy. "Nickel-base" as used herein means that the alloy contains more nickel by weight than any other element, for example, but not limited to, nickel-base superalloy, Rene 80. In alternative embodiments, other materials such as iron-base, cobalt-base or titanium-base alloys may be used.

Nozzle 200 may be of any operable shape, such as, for example, a gas turbine blade, a gas turbine vane, a gas turbine nozzle, a piece of tubing, a tool shape, a pump impeller, a pump rotor, a fan blade, or an element of electronic hardware. Nozzle 200 may be prepared by any operable approach known in the art, such as casting or forging. Nozzle 200 may be furnished in substantially its final shape and dimensions as the aluminide coating is thin and adds little to the dimensions of the article. In some cases, the article may instead be furnished slightly undersized to account for the thickness of the applied coating. A first portion of nozzle 200 may be masked with a second portion of nozzle 200 unmasked and exposed.

In the exemplary embodiment, nozzle 200 is illustrated partially masked for a aluminide coating process. An arcuate band of a plurality of outer maskant segments 214 overlay and are in contact with an outer periphery of outer band 204. Each outer maskant segment 214 includes a first circumferential end 216 and a second, opposite circumferential end 218. Each end 216 and 218 includes an interlocking tab 220 and an interlocking recess 222. In the exemplary embodiment, a radially inner surface (not shown) of segment 214 is machined to conform dimensionally to a radial outer surface (not shown) of outer band 204. In an alternative embodiment, the radially inner surface of segment 214 is molded to conform to the radially outer surface of outer band 204.

An arcuate band of inner maskant segments 224 overlay and contact an inner periphery 226 of inner band 206. Each inner maskant segment 224 includes a first circumferential end 228 and a second, opposite circumferential end 230. Each end 228 and 230 includes an interlocking tab 232 and an interlocking recess 234. In the exemplary embodiment, a radially outer surface 236 of segment 224 is machined to conform dimensionally to a radially inner surface 226 of inner band 206. In an alternative embodiment, the radially outer surface 236 of segment 224 is molded to conform to the radially inner surface 226 of inner band 206.

During the coating process, segments 214 and 224 are assembled to overlay and contact outer band 204 and inner band 206 respectively. Each surface of segments 214 and 224 that contacts inner and outer band 204 and 206 respectively is formed to conform to band surface to facilitate preventing the coating atmosphere from contacting the portions of the bands 204 and 206 that are in contact with mask segments 214 and 224. The machined surfaces of the segments that conform to the surfaces of bands 214 and 224 obviate the need to seal the edges of the contact surfaces to facilitate preventing coating atmosphere from reaching masked surfaces of band 204 and 206. Interlocking tabs 220 and recesses 222 of segments are engaged to facilitate providing lateral support to each adjacent segment and to provide a torturous path past ends 216 and 218. After coating and/or diffusion, the coated nozzle 200 may be cooled, and segments 214 and 224 may be removed and later reused.

Each graphite piece may be formed by molding or extruding and may be machined from a monolithic block of graphite that is formed in any manner as is known in the art.

Figure 3:
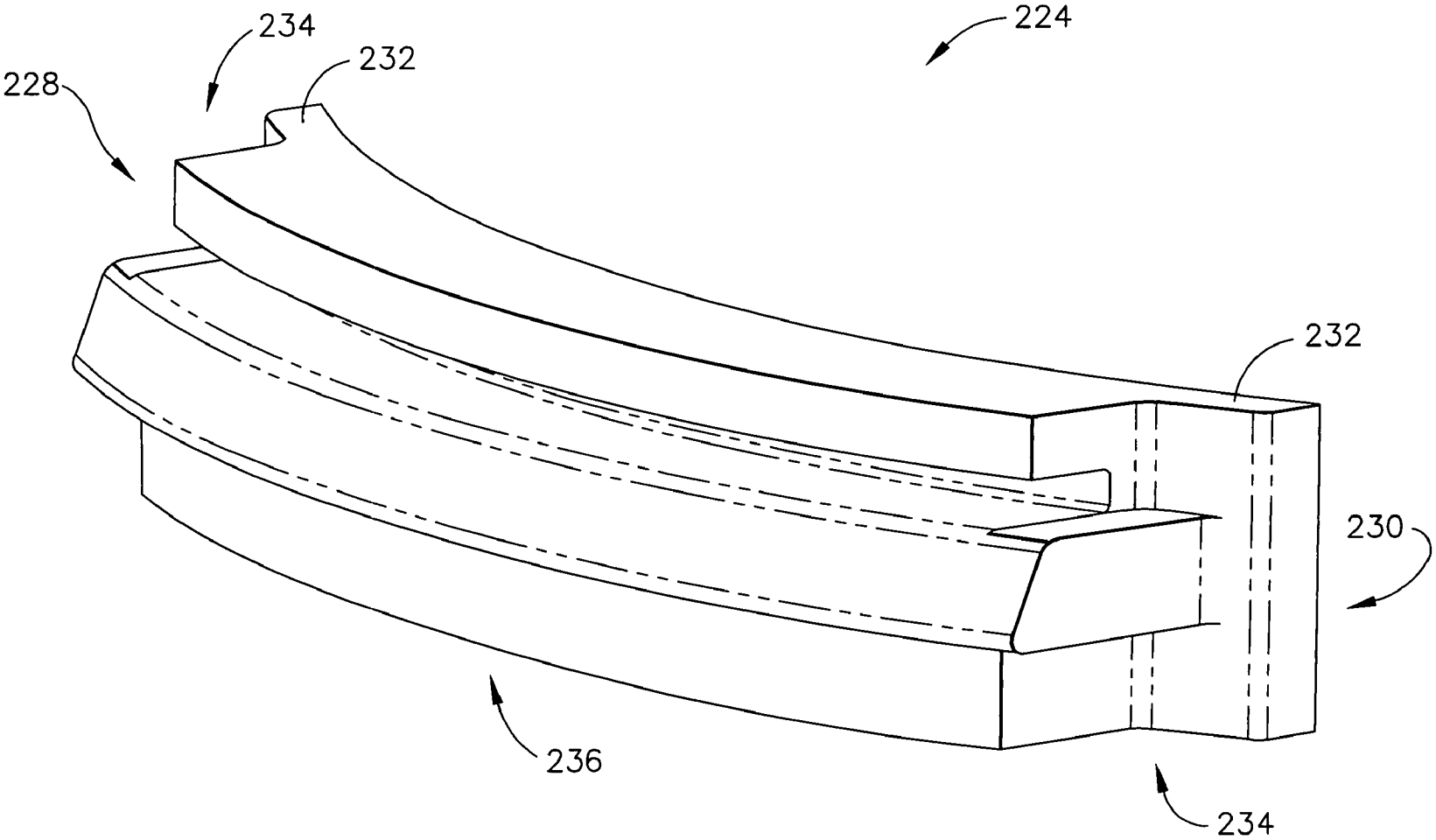
FIG. 3 is a perspective view of an exemplary inner mask segment that may be used with the nozzle shown in FIG. 2.

FIG. 3 is a perspective view of an exemplary inner mask segment 224 that may be used with nozzle 200 (shown in FIG. 2). Segment 224 includes first end 228 and second end 230. Each end 228 and 230 includes interlocking tab 232 and interlocking recess 234. Tab 232 and recess 234 are configured to engage and interlock with a tab and recess on each end of adjacent segments. Radially outer surface 236 of segment 224 is formed to conform to a respective mating face on inner band 206 (shown in FIG. 2).

Although segments 214 and 224 are illustrated in association with a process for masking a turbine nozzle, it should be understood that the methods and apparatus described above may be used to mask articles of shapes and orientations different than those describe herein. It is anticipated that free-standing and/or formed graphite maskants provide benefits that would accrue to articles of various shapes and orientations.

The above-described methods and systems for applying diffusion aluminide coating on a selective area of a turbine engine component is cost-effective and highly reliable for facilitating coating a portion of a component where a coating is desired and for facilitating preventing the coating atmosphere from contacting a portion of the component where a coating is not desired. Specifically, the freestanding, dimensionally stable mask segments are reusable and easily handled and positioned to protect the portion desired to be free of coating. As a result, the methods and apparatus described herein facilitate fabrication and maintenance of components in a cost-effective and reliable manner.

Exemplary embodiments of combinations of gas turbine engine components and coating masks are described above in detail. The combinations are not limited to the specific embodiments described herein, but rather, components of each combination may be utilized independently and separately from other components described herein. Each combination component can also be used in combination with other system components.

While the invention has been described in terms of various specific embodiments, those skilled in the art will recognize that the invention can be practiced with modification within the spirit and scope of the claims.

What is claimed is:

1. A coating mask for masking a portion of a substrate during coating of the substrate, said mask comprising:

a first graphite segment having a contoured surface that is shaped to substantially conform to a first portion of the substrate such that a second portion of the substrate to be coated is not contacted by the first graphite segment, the first graphite segment is configured to facilitate preventing a coating from being deposited on the first portion during coating of the substrate, said first graphite segment comprising a first interlocking tab;

a second graphite segment having a contoured surface that is shaped to substantially conform to a third portion of the substrate such that the second portion of the substrate to be coated is not contacted by the second graphite segment, the second graphite segment is configured to facilitate preventing a coating from being deposited on the third portion during coating of the substrate, said second graphite segment comprising a second interlocking tab, said first interlocking tab being configured to couple with said second interlocking tab to interlock said first and second graphite segments together, said first interlocking tab being outward of said second interlocking tab when the first and second graphite segments are coupled together; and a first plurality of graphite segments forming an inner mask comprising an outer surface that substantially conforms to an inner surface of the substrate.

2. A coating mask in accordance with claim 1, further comprising more than two graphite segments.

3. A coating mask in accordance with claim 1, wherein said first and second graphite segments are formed by at least one of molding, extruding, and machining.

4. A coating mask in accordance with claim 1 further comprising:

a second plurality of graphite segments adapted to cooperate with said first and second graphite segments in forming an outer mask comprising a circular inner surface that conforms to a circular outer surface of the substrate.

5. A coating mask in accordance with claim 1, wherein each of said first plurality of graphite segments comprises a groove sized and shaped for receiving a portion of the inner surface of the substrate therein.

6. A coating mask in accordance with claim 5, wherein said grooves cooperatively define an annual recess of said inner mask.

7. A coating mask in accordance with claim 1, wherein said first graphite segment comprises a recess for receiving said second interlocking tab therein, said second graphite segment comprises a recess for receiving said first interlocking tab therein.

8. A coating mask in accordance with claim 1, wherein said first graphite segment comprises two first interlocking tabs, a first of said first interlocking tabs is disposed on one end of said first graphite segment, a second of said first interlocking tabs is disposed on an opposite end of said first graphite segment.

9. A coating mask in accordance with claim 8, wherein said second graphite segment comprises two second interlocking tabs, a first of said second interlocking tabs is disposed on one end of said second graphite segment, a second of said second interlocking tabs is disposed on an opposite end of said second graphite segment.

* * * * *